US009673526B1

(12) United States Patent
Jensen et al.

(10) Patent No.: US 9,673,526 B1
(45) Date of Patent: Jun. 6, 2017

(54) DUAL-FREQUENCY STACKED PATCH ANTENNA

(71) Applicant: FIRST RF Corporation, Boulder, CO (US)

(72) Inventors: Anthony J. Jensen, Thornton, CO (US); P. Keith Kelly, Berthoud, CO (US)

(73) Assignee: FIRST RF Corporation, Boulder, CO (US)

( * ) Notice: Subject to any disclaimer, the term of this patent is extended or adjusted under 35 U.S.C. 154(b) by 319 days.

(21) Appl. No.: 14/656,646

(22) Filed: Mar. 12, 2015

Related U.S. Application Data

(60) Provisional application No. 61/951,652, filed on Mar. 12, 2014.

(51) Int. Cl.
*H01Q 13/10* (2006.01)
*H01Q 9/04* (2006.01)
*H01Q 1/12* (2006.01)

(52) U.S. Cl.
CPC ..... *H01Q 9/0414* (2013.01); *H01Q 1/12* (2013.01); *H01Q 13/10* (2013.01)

(58) Field of Classification Search
CPC ..... H01Q 9/1404; H01Q 1/12; H01Q 13/10
USPC ..... 343/700 MS, 769, 767, 725, 770
See application file for complete search history.

(56) References Cited

U.S. PATENT DOCUMENTS 2,885,676 A 5/1959 Baldwin
4,218,682 A 8/1980 Yu
4,733,245 A 3/1988 Mussler
2007/0052587 A1* 3/2007 Cheng ..... H01Q 9/0407 343/700 MS
2007/0268188 A1 11/2007 Guha et al.
2009/0251385 A1* 10/2009 Xu ..... H01Q 15/008 343/911 R
2012/0268347 A1 10/2012 Tatarnikov et al.
2013/0057442 A1* 3/2013 Brown ..... H01Q 1/48 343/750
2014/0266917 A1* 9/2014 De Luis ..... H01Q 19/005 343/700 MS (Continued)

OTHER PUBLICATIONS

Pozar et al., "A Dual-Band Circularly Polarized Aperture-Coupled Stacked Microstrip Antenna for Global Positioning Satellite", IEEE Transactions on Antennas and Propagation, Nov. 1997, pp. 1618-1625, vol. 45, No. 11.

(Continued)

*Primary Examiner* — Peguy Jean Pierre
(74) *Attorney, Agent, or Firm* — Christopher J. Kulish

(57) ABSTRACT

The invention is directed to a dual-frequency stacked patch antenna. In one embodiment, the antenna comprises a pair of electrically conductive, nested, tub-like structures and a feed surface. The edges of the tub-like structures and the feed surface define a surface that is adapted to be conformal to an application surface that defines a cavity in which the antenna is positioned. The edges of the tub-like structures and the edge of the feed surface define a pair of slots for receiving and/or transmitting two signals with different center frequencies. Located and extending throughout each of the slots is a slot modification structure comprised of interdigitated fingers that provide capacitive loading and enhance the low observability of the antenna.

22 Claims, 9 Drawing Sheets

(56) References Cited

U.S. PATENT DOCUMENTS

2016/0254590 A1* 9/2016 Seo ..... H04B 1/006

OTHER PUBLICATIONS

Karmakar et al., "Circularly Polarized Aperture-Coupled Circular Microstrip Patch Antennas for L-Band Applications", IEEE Transactions on Antennas and Propagation, May 1999, pp. 933-940, vol. 47, No. 5.
Fujimoto et al., "Dual-Band Circularly Polarized Microstrip Antenna for GPS Application", IEEE Antennas and Propagation Society International Symposium, 2008, pp. 1-4.
Maci et al., "Dual-Frequency Patch Antennas", IEEE Antennas and Propagation Magazine, Dec. 1997, pp. 13-20, vol. 39, No. 6.
Waterhouse, "Microstrip Antennas", IEEE Antennas and Propagation Society—Short Course, 2001, pp. 1-91.

* cited by examiner

Figure 5A
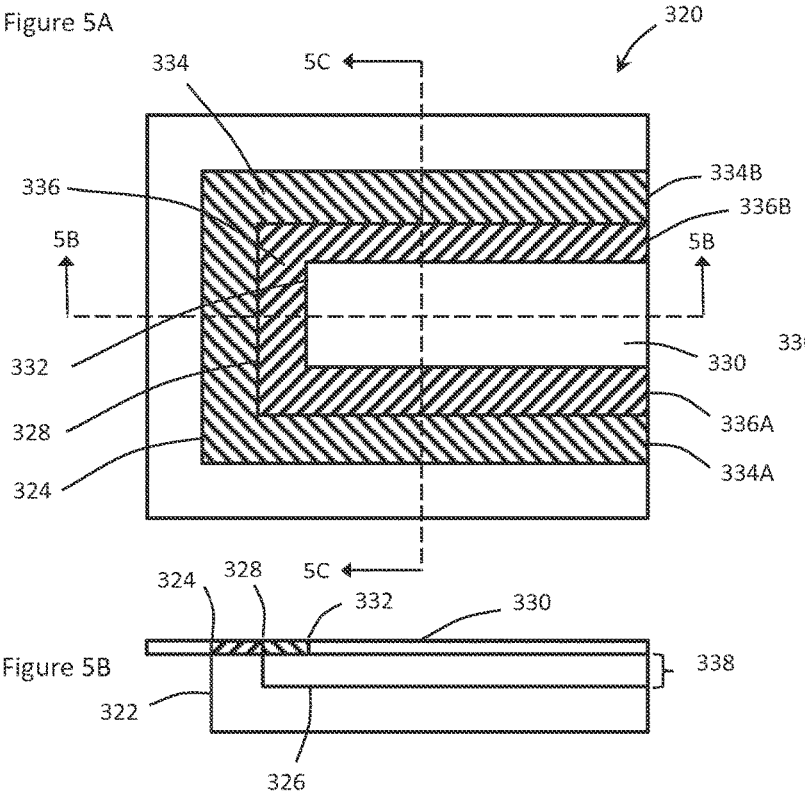
Figure 5B
Figure 5C
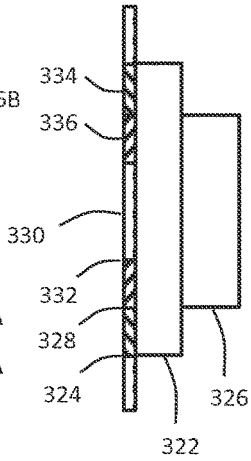

434B
436B
434
6C
420
436
6B
6B
430
430
428
432
424
434A
436A
6C 430
426
422

424
428
432
430
438
422
426

DUAL-FREQUENCY STACKED PATCH ANTENNA

FIELD OF THE INVENTION

The invention relates to antenna and, more specifically, to a dual-frequency patch antenna.

BACKGROUND OF THE INVENTION

Currently, a dual-frequency antenna is required to receive the data present in the L1 (1.575 GHz) and L2 (1.227 GHz) signals transmitted by the satellites in the Global Positioning System (GPS). There are several different types of dual-frequency patch antennas that are capable of receiving (or transmitting) two signals, such as the L1 and L2 signals used in the GPS. Among these dual-frequency patch antennas are (a) orthogonal-mode dual-frequency antennas with a single-point or dual-point feed, (b) multi-patch dual-frequency antennas in which the patches are stacked or co-planar, and (c) reactively loaded patch antennas in which the reactive loading is achieved using a stub, notch, pin, capacitor, or slot. A discussion of each of these types of dual frequency antennas can be found in Maci et al., *Dual-Frequency Patch Antennas, IEEE Antennas and Propagation Magazine*, December 1997, pp. 13-20, Vol. 39, No. 6, which is incorporated herein by reference. Generally, a stacked patch antenna comprises: (a) ground plane, (b) a first patch (i.e., a thin metallic region) disposed to one side of the ground plane, (c) a second patch disposed between the ground plane and the first patch, (d) a dielectric structure disposed between the first and second patches and between the second patch and the ground plane, and (e) a feed structure for conveying an electrical signal having a first frequency to and/or from the first patch and an electrical signal having a second frequency to and/or from the second patch.

SUMMARY OF THE INVENTION

The invention is directed to a dual frequency stacked patch antenna structure suitable for positioning in an application cavity.

In one embodiment, the dual frequency stacked patch antenna structure comprises: (a) a first electrically conductive element with a first concave surface and an extent that is defined by a first edge, (b) a second electrically conductive element with a second concave surface and an extent that is defined by a second edge, and (c) a third electrically conductive element having an extent defined by a third edge. The first and second electrically conductive elements are positioned with respect to one another such that the first and second concave surfaces point in the same direction. Further, the second electrically conductive element is substantially located between the first and third electrically conductive elements. As such, the antenna can be characterized as the second electrically conductive element being substantially located in an envelope defined by the first electrically conductive element, the third electrically conductive element, and an imaginary surface extending between the first edge of the first electrically conductive element and the third edge of the third electrically conductive element. In a particular embodiment, a first multi-digit electrically conductive structure extends between the first and second edges and a second multi-digit electrically conductive structure extends between the second and third edges. The first and second multi-digit structures operate so as to enhance the low-observability of the antenna. In another embodiment, a first pair of interleaved multi-digit electrically conductive structures extends between the first and second edges and a second pair of interleaved multi-digit electrically conductive structures extend between the second and third edges. The first and second pairs of interleaved multi-digit electrically conductive structures serve, in operation, to enhance the low-observability of the antenna and to capacitively load the antenna, which allows the footprint of the antenna to be reduced relative to an antenna that is not capacitively loaded. In yet a further embodiment, the second edge is located so that first, second, and third edges define a surface that is substantially conformal with the application surface that is adjacent to the application cavity. For instance, if the application surface is planar, the first, second, and third edges define a planar surface that is substantially conformal with the application surface. In contrast, if the application surface is curved (e.g., the fuselage of an aircraft), the first, second and third edges define a curved surface that is substantially conformal with the portion of the fuselage surface adjacent to the cavity into which the antenna is to be operationally positioned. In a particular embodiment, the third electrically conductive element is also conformal with the application surface.

In one embodiment, the dual frequency stacked patch antenna comprises: (a) a first electrically conductive element with a surface that has a tub-like shape defined by an first side wall and a first bottom wall that is operatively connected to the first side wall, the first side wall having a first edge that will be substantially conformal with an application surface and defining an opening for a first cavity defined by the first side wall and the first bottom wall; (b) a second electrically conductive element with a surface substantially located within a boundary defined by the first bottom wall, the first side wall and an imaginary extension of the first side wall away from the first bottom wall, the element also having a tub-like shape defined by a second side wall and a second bottom wall that is operatively connected to the second side wall, the second side wall having an second edge that will be substantially conformal with the application surface and defining an opening for second cavity defined by the second side wall and the second bottom wall; and (c) a third electrically conductive element located substantially within a boundary defined by the second bottom surface, the second side surface, and an imaginary extension of the second side wall away from the second bottom wall, the third electrically conductive element also being located to be substantially conformal with the application surface and having a third edge that defines the extent of the element. The first edge, second edge, third edge, and exterior surface of the third electrically conductive element define a conformal surface that will be substantially conformal with the application surface. The conformal surface enhances the low observability of the antenna. The conformal surface defines two slots that are used to receive and/or transmit two signals of different center frequencies. More specifically, the first edge of the first side wall and the second edge of the second side wall define a first slot for transmitting/receiving one of the two signals. The second edge of the second side wall and the third edge define the second slot for transmitting/receiving the other of the two signals.

The two slots can each take one of a closed-loop form and non-closed loop form in which the slot extends between two terminal ends. An example of a slot with a closed loop form is a slot with an elliptical, circular, or rectangular shape. A slot that extends in a straight line from a first terminal end to a second terminal end is an example of a slot with a non-closed loop form. In one particular embodiment of the antenna, both of the slots are circular and coaxial.

In yet another embodiment, the antenna includes a slot modification structure that extends between the edges that define a slot. In one embodiment, the slot modification structure includes finger-like elements that extend into the slot from each of the opposing edges that define the slot and that interlock within one another (similar to a zipper) but do not contact one another. In a particular embodiment of the antenna, each of the slots has a slot modification structure that extends along the entire extent of the slot. In this case, the slot modification structures serve both to provide the antenna with low observability and to capacitively load the antenna, thereby allowing the footprint of the antenna to be reduced relatively to antenna with comparable performance that is not capacitively loaded.

In one embodiment, the dual frequency stacked patch antenna comprises three structures. The first structure is a first electrically conductive surface with a tub-like shape defined by a first side wall and a first bottom wall that is operatively connected to the first side wall, the first side wall having a first edge that will be substantially conformal with an application surface and defining an opening for a first cavity defined by the first side wall and the first bottom wall. The second structure is substantially located within the outer cavity and comprised of (a) a planar dielectric element with a first planar face and a second planar face that is substantially parallel to the first planar face, (b) a second electrically conductive surface with a tub-like shape having a second bottom wall operatively attached to the second planar face and a second side wall extending from a second edge that is substantially adjacent to the first planar face to the second bottom wall adjacent to the second planar face, and (c) a third electrically conductive surface operatively attached to the first planar face, located within a boundary defined by the second edge of the second side wall of the second surface, and having a third edge that defines the extent of the third electrically conductive surface. The third structure is a planar dielectric element located between the second bottom wall of the second surface and the first bottom wall of the first surface. The first edge, second edge, third edge, and the exterior of the third electrically conductive surface define a conformal surface that will be substantially conformal with an application surface. The conformal surface defines two slots that are used to receive and/or transmit two signals of different center frequencies. More specifically, the first edge of the first side wall and the second edge of the second side wall define a first slot for transmitting/receiving one of the two signals. The second edge of the second side wall and the third edge of the third electrically conductive surface define the second slot for transmitting/receiving the other of the two signals. In a particular embodiment, the second structure includes: (a) a first and second multi-digit electrically conductive structures, with the first structure extending from the second edge towards the first edge and the second structure extending from the second edge towards the third edge, (b) a third multi-digit electrically conductive structure extending from the first edge towards the second edge and interleaved with the first multi-digit electrically conductive structure, and (c) a fourth multi-digit electrically conductive structure extending from the third edge towards the second edge and interleaved with the second multi-digit electrically conductive structure.

BRIEF DESCRIPTION OF THE DRAWINGS

FIGS. 5A-5C respectively show schematic and orthogonal top, first side, and second side views of an embodiment of a dual-frequency stacked patch antenna that defines first and second slots that each form a non-closed loop;

DETAILED DESCRIPTION

Figure 1A:
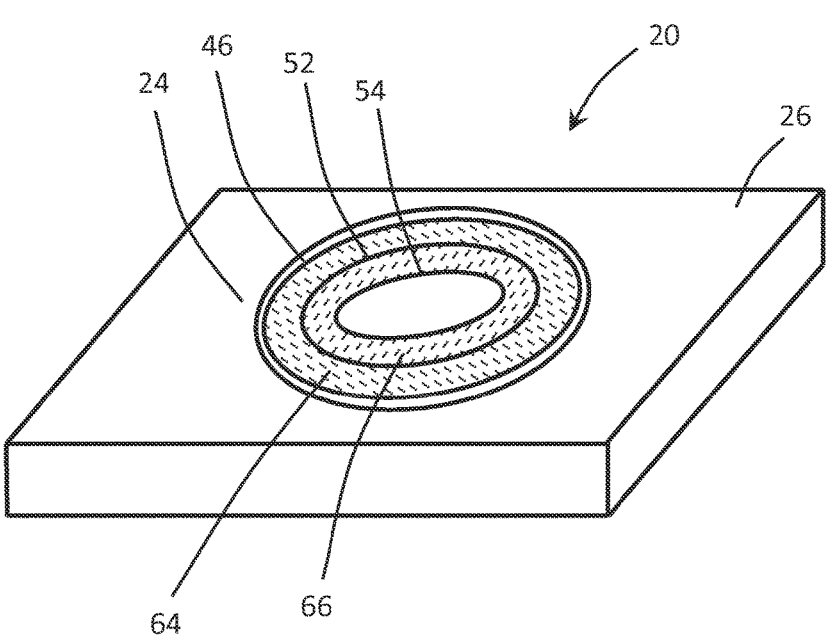
FIGS. 1A and 1B respectively are a perspective view and a cross-sectional view of an embodiment of a dual-frequency stacked patch antenna.
Figure 1B:
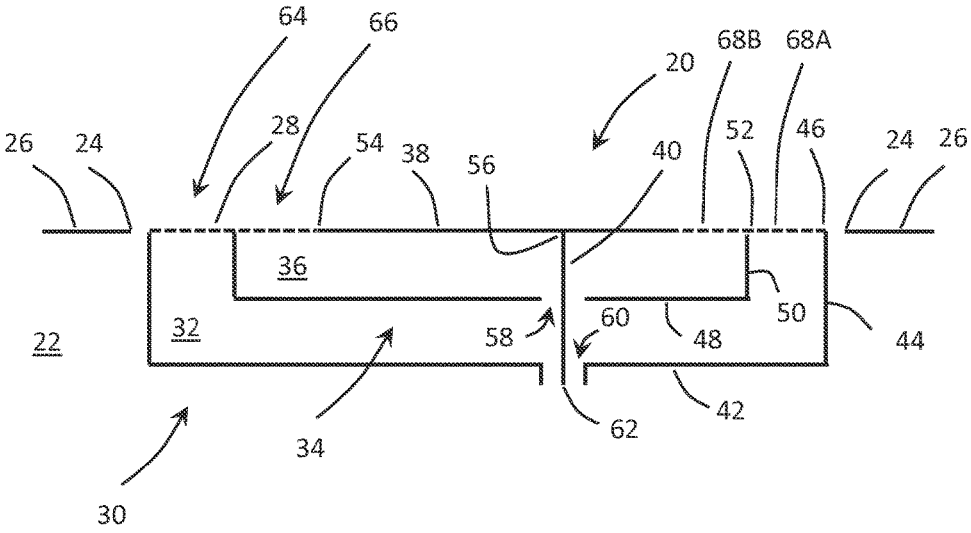

With reference to FIGS. 1A and 1B, a first embodiment of a dual-frequency stacked patch antenna, hereinafter antenna 20 structure, is described. The antenna 20 is adapted to reside in a cavity 22 defined, at least in part, by an edge 24 of an application surface 26. Further, the antenna 20 has or defines an outer surface 28 that is substantially conformal with the application surface 26 adjacent to the edge 24 and, as such, substantially preserves the character of the application surface 26. In the illustrated embodiment, the antenna 20 is conformal with the application surface 26 due to the outer surface 28 being planar, the application surface 26 being planar, and the outer surface 28 being substantially coplanar with the application surface 26.

The antenna 20 comprises a first electrically conductive element with a first surface 30 that has concave shape that defines an outer cavity 32, a second electrically conductive element with a second surface 34 that also has a concave shape that defines an inner cavity 36, a third electrically conductive element 38, and a feed pin 40 for providing an electrical signal to or receiving an electrical signal from the third electrically conductive element 38.

The first surface 30 includes a first bottom wall 42 and a first side wall 44 that extends from the first bottom wall 42 to a first edge 46. As such, the first surface 30 has a tub-like shape. However, it should be appreciated that other concave shapes (e.g., pie-tin shape, saucer-shaped etc.) can be employed in other embodiments.

The second surface 34 substantially resides within the outer cavity 32. Further, the second surface 34 comprises a second bottom wall 48 and a second side wall 50 that extends from the inner bottom wall 48 to an inner edge 52. As such, the second surface 34 has a tub-like shape. However, it should be appreciated that other concave shapes (e.g., pie-tin shape, saucer-shaped etc.) can be employed in other embodiments. Further, while the second surface 34 substantially resides within a space defined by the first surface 30 and an imaginary plane that engages the first edge 46, a second surface that lies within a boundary defined by a first surface and an imaginary extension of the surface in which the first edge is moved so as to render the first surface deeper while still maintaining the concave shape of the first surface is also feasible.

The third electrically conductive element 38 is located within a boundary defined by the second edge 52 of the second side wall 50 and has a lateral extent defined by a third edge 54. Further, while the third electrically conductive element 38 substantially resides within a boundary defined by the second edge 52, a third electrically conductive element that lies within a boundary defined by a second surface and an imaginary extension of the surface in which the second edge is moved so as to render the second surface deeper while still maintaining the concave shape of the second surface is also feasible. The third electrically conductive element 38 is planar and substantially coplanar with the first edge 46 and the second edge 52. The first edge 46, second edge 52, and the exterior side of the third electrically conductive element 38 define a plane that includes the outer surface 28. When the antenna 20 is operatively positioned in the cavity 22, the outer surface 28 is substantially coplanar with the application surface 26. By rendering the outer surface 28 of the antenna 20 to be conformal with the application surface 26, the low observability of the antenna 20 is enhanced relative to a non-conformal antenna.

The feed pin 40 extends from a first end 56 that electrically contacts the third electrically conductive element 38, through hole 58 defined by the second surface 34, through hole 60 defined by the first surface 30, and terminates at a second end 62 that is associated with a coaxial connector. The feed pin 40 is used to convey electrical signals at both of the center frequencies at which the antenna is designed to operate. The electrical signal with the higher of the two frequencies is associated with the cavity located between the second surface 34 and the third electrically conductive element 38 and is directly fed to the third electrically conductive element. The electrical signal with the lower of the two frequencies is associated with the cavity located between the first surface 30 and the second surface 34 and is indirectly fed to the second surface 34 by employing capacitive coupling between the third electrically conductive element 38 and the second surface 34. It should be appreciated that other mechanisms (e.g., transmission line, microstrip, stripline, coplanar strip line, and coplanar waveguide to name a few) can be used to convey electrical signals to and/or from a feed pin that is electrically connected to the third electrically conductive member 38. Additionally, the locations of the holes defined by the first surface 30 and the second surface 34 through which a feed pin passes to engage the third electrically conductive element 38 can be altered as known to those skilled in the art to accommodate, for example, constraints associated with the cavity into which the antenna is to be operationally located. It should also be appreciated that a second pin can be employed to facilitate the sending and/or receiving of elliptically/circularly polarized signals. Further, a feed structure that does not employ capacitive coupling can be employed to convey the two different frequency signals. In such a feed structure, a first pin (or other suitable transmission structure) is used to convey the higher frequency signal to and/or from the third electrically conductive element 38 and a separate second pin (or other suitable transmission structure) is used to convey the lower frequency signal to and/or from the second surface 34. The holes defined by the first surface 30 and the second surface 34 to accommodate the two transmission structures can be located at various locations along the first and second surfaces as known to those skilled in the art. Further, additional pins or other suitable transmission structures can be employed to facilitate the transmitting and/or receiving of elliptically/circularly polarized signals.

The first edge 46 and the second edge 52 also define a first circular slot 64 for receiving and/or transmitting a first signal with a first center frequency. The second edge 52 and the third edge 54 define a second circular slot 66 for receiving and/or transmitting a second signal with a second center frequency that is at a higher frequency than the first center frequency. The first circular slot 64 and second circular slot 66 are substantially coplanar and coaxial. It should be appreciated that, while the antenna 20 can be used to receive and/or transmit two signals, the incorporation of additional electrically conductive concave surfaces can be used to produce additional slots for transmitting/receiving additional signals. Respectively located within the first and second circular slots 64, 66 are first and second multi-digit structures 68A, 68B. In a preferred embodiment, the first multi-digit structure 68A comprises a first multi-digit sub-structure that extends from the first edge 46 towards the second edge 52 and a second multi-digit sub-structure that extends from the second edge 52 towards the first edge 46 with the digits of the first and second multi-digit sub-structures interleaving with one another. The second multi-digit structure 68B comprises a third multi-digit sub-structure that extends from the second edge 52 towards the third edge 54 and a fourth multi-digit sub-structure that extends from the third edge 54 towards the second edge 52 with the digits of the third and fourth multi-digit sub-structures interleaving with one another. The first and second multi-digit structures 68A, 68B function: (a) to capacitively load the antenna 20, which facilitates a reduced footprint for the antenna, and (B) to reduce the observability of the antenna 20.

Typically, a solid dielectric structure or group of solid dielectric structures substantially occupy the space between the first surface 30 and the second surface 34 and the space between the second surface 34 and the third electrically conductive element 38. These solid dielectric structures serve, at least in part, to maintain the positional relationships of the first surface 30, second surface 34, and the third electrically conductive element 38 to one another. However, a dielectric gas (e.g., air) or liquid dielectric material can be employed in one of both of the cavities, provided sufficient structure is provided to maintain the positional relationship of the first surface 30, second surface 34, and third electrically conductive element 38 to one another.

Figure 2A:
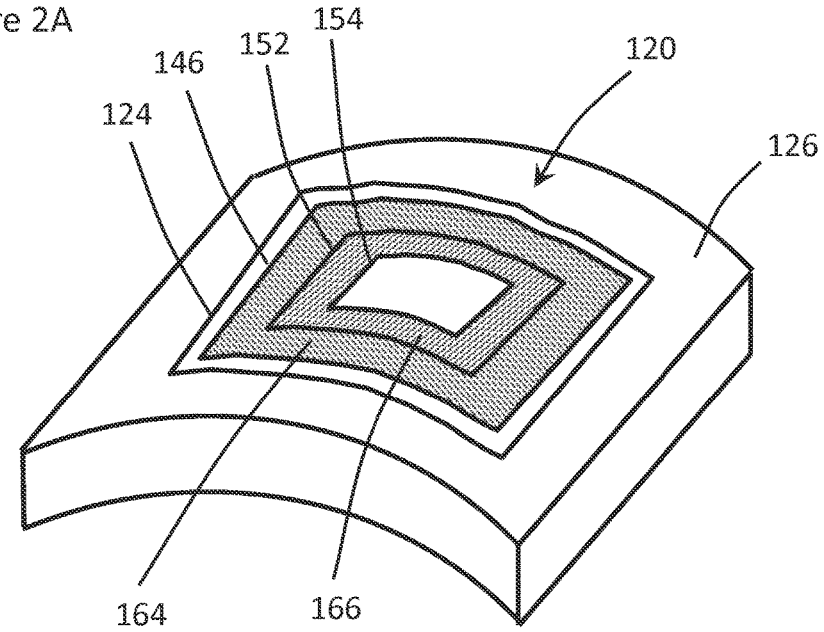
FIGS. 2A and 2B respectively are a perspective view and a cross-sectional view of a second embodiment of a dual-frequency stacked patch antenna.
Figure 2B:
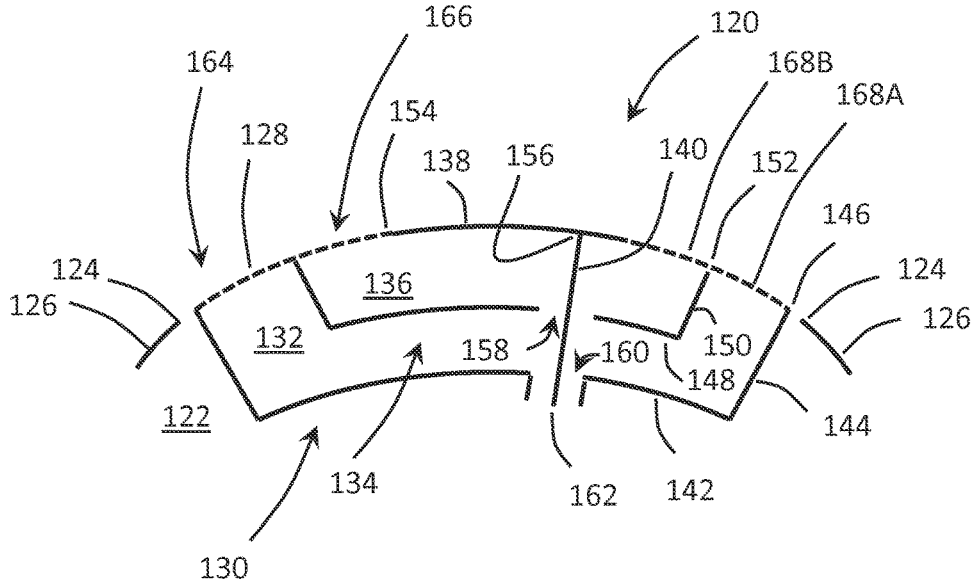

With reference to FIGS. 2A and 2B, a second embodiment of a dual-frequency stacked patch antenna, hereinafter antenna 120 structure, is described. The antenna 120 is adapted to reside in a cavity 122 defined, at least in part, by an edge 124 of an application surface 126. The application surface 126 is partially cylindrical. As such, the antenna 120 has or defines an outer surface 128 that has cylindrical character and is substantially conformal with the application surface 126.

The antenna 120 comprises a first electrically conductive element with a first surface 130 that has a concave shape that defines an outer cavity 132, a second electrically conductive element with a second surface 134 that also has a concave shape that defines an inner cavity 136, a third electrically conductive element 138, and a feed pin 140 for providing an electrical signal to and/or receiving an electrical signal from the third electrically conductive element 138.

The first surface 130 includes a first bottom wall 142 and a first side wall 144 that extends from the first bottom wall 142 to a first edge 146. The first bottom wall 142 has a partially cylindrical shape that is coaxial with the application surface 126. The first side wall 144 extends radially from the first bottom wall 142 to the first edge 146. As such, the first side wall 144 comprises two opposing rectangular walls and two opposing and parallel annular segments. The first edge 146 defines a partially cylindrical surface. As such, the first surface 130 has a tub-like shape. However, it should be appreciated that other concave shapes (e.g., pie-tin shape, saucer-shaped etc.) can be employed in other embodiments.

The second surface 134 substantially resides within the outer cavity 132. Further, the second surface 134 comprises a second bottom wall 148 and a second side wall 150 that extends from the second bottom wall 148 to a second edge 152. The second bottom wall 148 has a partially cylindrical shape that is coaxial with the application surface 126. The second side wall 150 extends radially from the second bottom wall 148 to the second edge 152. As such, the second side wall 150 comprises two opposing rectangular walls and two opposing and parallel annular segments. The second edge 152 defines a partially cylindrical surface. As such, the second surface 134 has a tub-like shape. However, it should be appreciated that other concave shapes (e.g., pie-tin shape, saucer-shaped etc.) can be employed in other embodiments. Further, while the second surface 134 substantially resides within a space defined by the first surface 130 and an imaginary plane that engages the first edge 146, a second surface that lies within a boundary defined by a first surface and an imaginary extension of the surface in which the first edge is moved so as to render the first surface deeper while still maintaining the concave shape of the first surface is feasible.

The third electrically conductive element 138 is located within a boundary defined by the second edge 152 of the second side wall 150 and has a lateral extent defined by a third edge 154. Further, while the third electrically conductive element 138 substantially resides within a boundary defined by the second edge 152, a third electrically conductive element that lies within a boundary defined by a second surface and an imaginary extension of the surface in which the second edge is moved so as to render the second surface deeper while still maintaining the concave shape of the second surface is also feasible. The third electrically conductive element 138 is partially cylindrical. The first edge 146, second edge 152, and the exterior side of the third electrically conductive element 138 define the outer surface 128, which is partially cylindrical and conforms to the application surface 126. By rendering the outer surface 128 of the antenna 120 partially cylindrical and conformal with the application surface 126, the low observability of the antenna 120 is enhanced relative to a non-conformal antenna.

The feed pin 140 extends from a first end 156 that electrically contacts the third electrically conductive element 138, through hole 158 defined by the second surface 134, through hole 160 defined by the first surface 130, and terminates at a second end 162 that is associated with a coaxial connector. It should be appreciated that other mechanisms (e.g., transmission line, microstrip, stripline, coplanar strip line, and coplanar waveguide to name a few) can be used to convey electrical signals to and/or from a feed pin that is electrically connected to the feed surface 138 and extends at least through hole 158. As noted with respect to the antenna 20, many different types of feed structures can be employed with the antenna 120.

The first edge 146 and the second edge 152 also define a first rectangular and partially cylindrical slot 164 for receiving and/or transmitting a first signal with a first center frequency. The second edge 152 and the third edge 154 define a second rectangular and partially cylindrical slot 166 for receiving and/or transmitting a second signal with a second center frequency that is at a higher frequency than the first center frequency. The first rectangular and partially cylindrical slot 164 and second rectangular and partially cylindrical slot 166 are cylindrically coplanar and have a common center point, which is the point at which lines extending between opposing vertices of the rectangles intersect. Respectively located within the first and second circular slots 164, 166 are first and second multi-digit structures 168A, 168B. In a preferred embodiment, the first multi-digit structure 168A comprises a first multi-digit sub-structure that extends from the first edge 146 towards the second edge 152 and a second multi-digit sub-structure that extends from the second edge 152 towards the first edge 146 with the digits of the first and second multi-digit sub-structures interleaving with one another. The second multi-digit structure 168B comprises a third multi-digit sub-structure that extends from the second edge 152 towards the third edge 154 and a fourth multi-digit sub-structure that extends from the third edge 154 towards the second edge 152 with the digits of the third and fourth multi-digit sub-structures interleaving with one another. The first and second multi-digit structures 168A, 168B function: (a) to capacitively load the antenna 20, which facilitates a reduced footprint for the antenna, and (B) to reduce the observability of the antenna 20.

Typically, a solid dielectric structure or group of solid dielectric structures substantially occupy the space between the first surface 130 and the second surface 134 and the space between the second surface 134 and the cylindrical plane defined by the third electrically conductive element 138. These solid dielectric structures serve, at least in part, to maintain the positional relationships of the first surface 130, second surface 134, and third electrically conductive element 138 to one another. However, a dielectric gas (e.g., air) or liquid dielectric material can be employed in one of both of the cavities, provided sufficient structure is provided to maintain the positional relationship of the first surface 130, second surface 134, and third electrically conductive element 138 to one another.

Figure 3A:
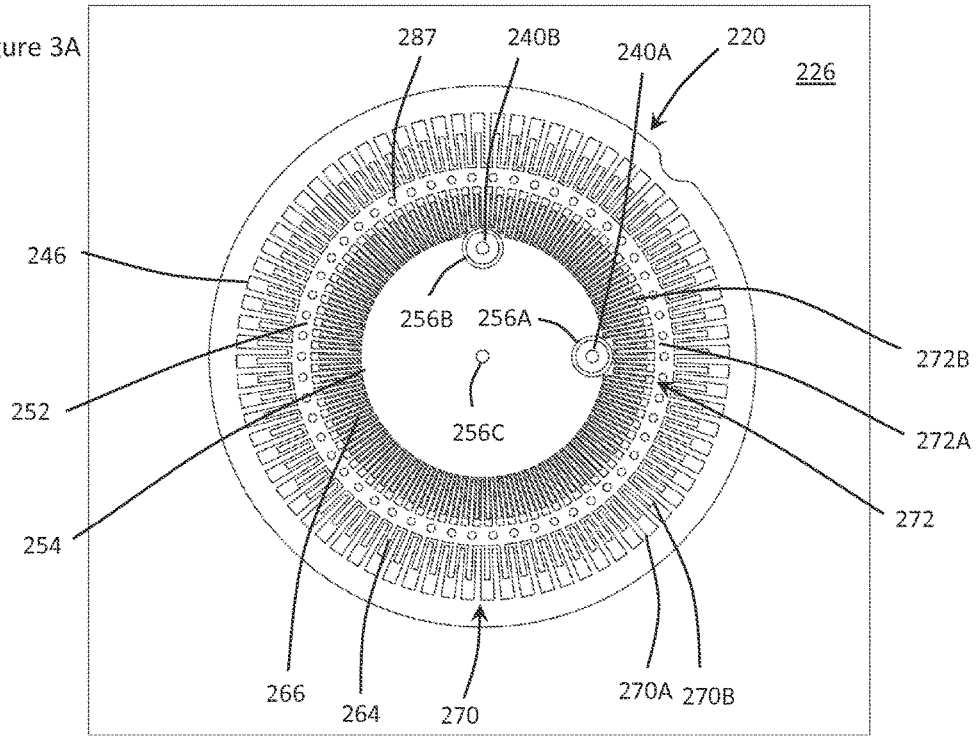
FIGS. 3A-3B respectively are a plan view and a cross-sectional view of a third embodiment of a conformal dual-frequency stacked patch antenna.
Figure 3B:
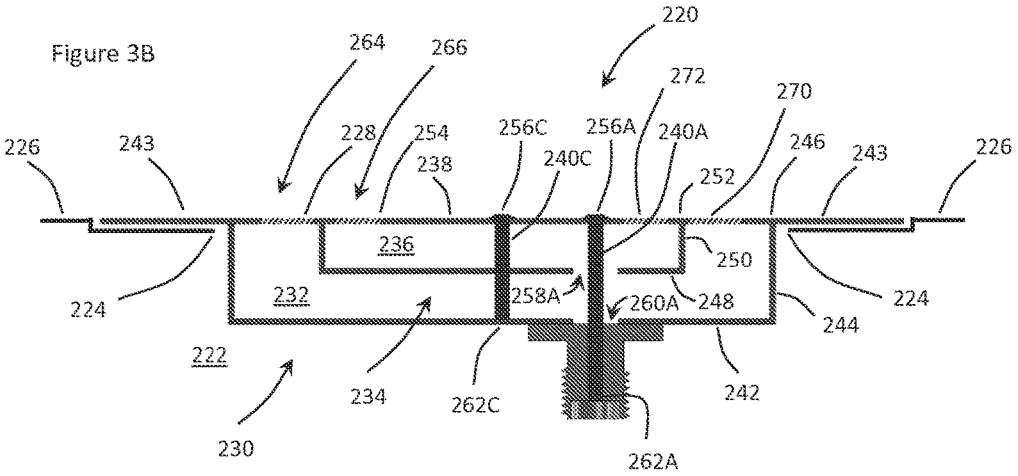

With reference to FIGS. 3A-3B, a third embodiment of a dual-frequency stacked patch antenna, hereinafter antenna structure 220, is described. The antenna 220 is adapted to reside in a cavity 222 defined, at least in part, by an edge 224 of an application surface 226. Further, the antenna 220 has or defines an outer surface 228 that is planar and substantially conformal with the application surface 226 adjacent to the edge 224, which is also planar.

The antenna 220 comprises a first electrically conductive element with a first surface 230 that has a concave shape which defines an outer cavity 232, a second electrically conductive element with a second surface 234 that also has a concave shape which defines an inner cavity 236, a third electrically conductive element 238, a first feed pin 240A for providing an electrical signal to and/or receiving an electrical signal from the third electrically conductive element 238, a second feed pin 240B for providing an electrical signal and/or an electrical signal from the third electrically conductive element 238, and shorting pin 240C that engages each of the first surface 230, second surface 234, and the third electrically conductive element 238. The use of the first and second feed pins allows elliptically/circularly polarized signals to be transmitted and/or received by the antenna 220. The shorting pin 240C provides an electrical path for the discharge of static electricity that can build up on the antenna 220 and, if not discharged, adversely affect the performance of the antenna.

The first surface 230 includes a first bottom wall 242 and a first side wall 244 that extends from the outer bottom wall 242 to a first edge 246. As such, the first surface 230 has a tub-like shape. Other concave shapes can be employed in other embodiments. The first surface 230 also includes a flange 243 that extends from the first edge 246. When the antenna 220 is operatively located in the cavity 222, the flange 243 is disposed in a recessed portion of application surface 226 and the exposed surface of the flange 243 is substantially conformal with the portion of the application surface 226 extending beyond the recessed portion. The flange 243 and the recessed portion of the application surface provide surfaces for establishing the antenna 220 in the cavity 222. Numerous other structures known to those skilled in the art can be used to establish the antenna 220 in the cavity 222 defined by an application structure.

The second surface 234 substantially resides within the outer cavity 232. Further, the second surface 234 comprises a second bottom wall 248 and a second side wall 250 that extends from the inner bottom wall 248 to a second edge 252. As such, the second surface 234 has a tub-like shape. Other concave shapes can be employed in other embodiments. Further, while the second surface 234 substantially resides within a space defined by the first surface 230 and an imaginary plane that engages the first edge 246, a second surface that lies within a boundary defined by a first surface and an imaginary extension of the surface in which the first edge is moved so as to render the first surface deeper while still maintaining the concave shape of the first surface is feasible.

The third electrically conductive surface 238 is located within a boundary defined by the second edge 252 of the second side wall 250 and has a lateral extent defined by a third edge 254. Further, while the third electrically conductive element 238 substantially resides within a boundary defined by the second edge 252, a third electrically conductive element that lies within a boundary defined by a second surface and an imaginary extension of the surface in which the second edge is moved so as to render the second surface deeper while still maintaining the concave shape of the second surface is also feasible. The third electrically conductive element 238 is planar and substantially coplanar with the exposed surface of the flange 243, the first edge 246, and the second edge 252. The exposed surface of the flange 243, first edge 246, second edge 252, and the exterior surface of the third electrically conductive element 238 define the outer surface 228, which is coplanar with the portion of the application surface 226 beyond the recess that receives the flange 243. By rendering the outer surface 228 of the antenna 220 coplanar and conformal with the portion of the application surface 226 beyond the recess that receives the flange 243, the low observability of the antenna 220 is enhanced relative to a non-conformal antenna.

The feed pin 240A extends from a first end 256A that electrically contacts the third electrically conductive element 238, through a hole 258A defined by the second surface 234, through a hole 260A defined by the first surface 230, and terminates at a second end 262A that is associated with a coaxial connector. The feed pin 240B extends from a first end 256B that electrically contacts the third electrically conductive element 238, through a hole (not shown) defined by the second surface 234, through a hole (not shown) defined by the first surface 230, and terminates at a second end 262B that is associated with a coaxial connector (not shown). It should be appreciated that other mechanisms (e.g., transmission line, microstrip, stripline, coplanar strip line, and coplanar waveguide to name a few) can be used to convey electrical signals to and/or from a feed pin that is electrically connected to the feed surface 238. The two pins 240A, 240B utilize capacitive coupling to convey the lower frequency signal to and/or from the second surface 234. A feed structure comprised of four pins or other suitable transmission structures can be used with two pins electrically connected to the third electrically conductive element 238 and the other two pins electrically connected to the second surface 234. The holes defined by the first surface 230 and the second surface 234 to accommodate the transmission structures can be located at various locations along the first and second surfaces as known to those skilled in the art. The shorting pin 240C extends from a first end 256C that electrically contacts the third electrically conductive element 238, through and electrically contacting the second bottom wall 248, and terminates at a second end 262C that electrically contacts the first bottom wall 242.

Typically, a solid dielectric structure or structures substantially occupy the space between the first surface 230 and the second surface 234 and the space between the second surface 234 and the plane defined by the third electrical element 238. These solid dielectric structure(s) serve, at least in part, to maintain the positional relationships of the first surface 230, second surface 234, and third electrically conductive element 238 to one another. However, a dielectric gas (e.g., air) or liquid dielectric material can be employed in one of both of the cavities, provided sufficient structure is provided to maintain the positional relationship of the first surface 230, second surface 234, and third electrically conductive element 238 to one another.

The first edge 246 and the second edge 252 also define a first circular slot 264 for receiving and/or transmitting a first signal with a first center frequency. The second edge 252 and the third edge 254 define a second circular slot 266 for receiving and/or transmitting a second signal with a second center frequency that is different than the first center frequency. The first circular slot 264 and second circular slot 266 are coplanar and coaxial.

Respectively located within the first and second circular slots 264, 266 are slot modification structures 270, 272 that each serve to reduce the observability of, and capacitively load, the slot with which the structure is associated. Capacitively loading the slot allows the footprint of the antenna 220 to be reduced relative an antenna that is not capacitively loaded. The slot modification structure 270 comprises finger-like structures 270A that extend from the first edge 246 towards the second edge 252 and finger-like structures 270B that extend from the second edge 252 towards the first edge 246 and are located in the spaces between consecutive ones of the finger-like structures 270A. As such, the finger-like structures 270A, 270B have a regular inter-digitated or interleaved pattern that is continuous throughout the first circular slot 264.

The slot modification structure 272 comprises finger-like structures 272A that extend from the second edge 252 towards the third edge 254 and finger-like structures 272B that extend from the third edge 254 towards the second edge 252 and are located in the spaces between consecutive ones of the finger-like structures 272A. As such, the finger-like structures 272A, 272B have a regular inter-digitated or interleaved pattern that is continuous throughout the second circular slot 266.

It should be appreciated that a slot modification structure with an irregular inter-digitated pattern that is not continuous throughout whichever of the first and second circular slots 264, 266 the slot modification is employed can be used and provide the low observability and capacitive loading with respect to the slot with which the slot modification structure is employed, provided the features of the structure are electrically small at the highest frequency signal (typically, less than 0.1λ) that is likely to be used to observe the antenna 220. Further, in particular applications, a slot modification structure can be employed that creates capacitive loading but does little, if anything, to enhance low observability. In yet other applications, a slot modification structure can be employed that provides low observability but does little, if anything, in terms of capacitive loading. For instance, a multi-digit structure can be established in a slot that is not interleaved with another multi-digit structure. Such a multi-digit structure provides little, if any, capacitive loading but can enhance the low-observability of the antenna. Additionally, a slot modification structure that provides low observability and/or capacitive loading may be employed with one of the slots but not the other slot may be appropriate in certain applications.

Figure 4:
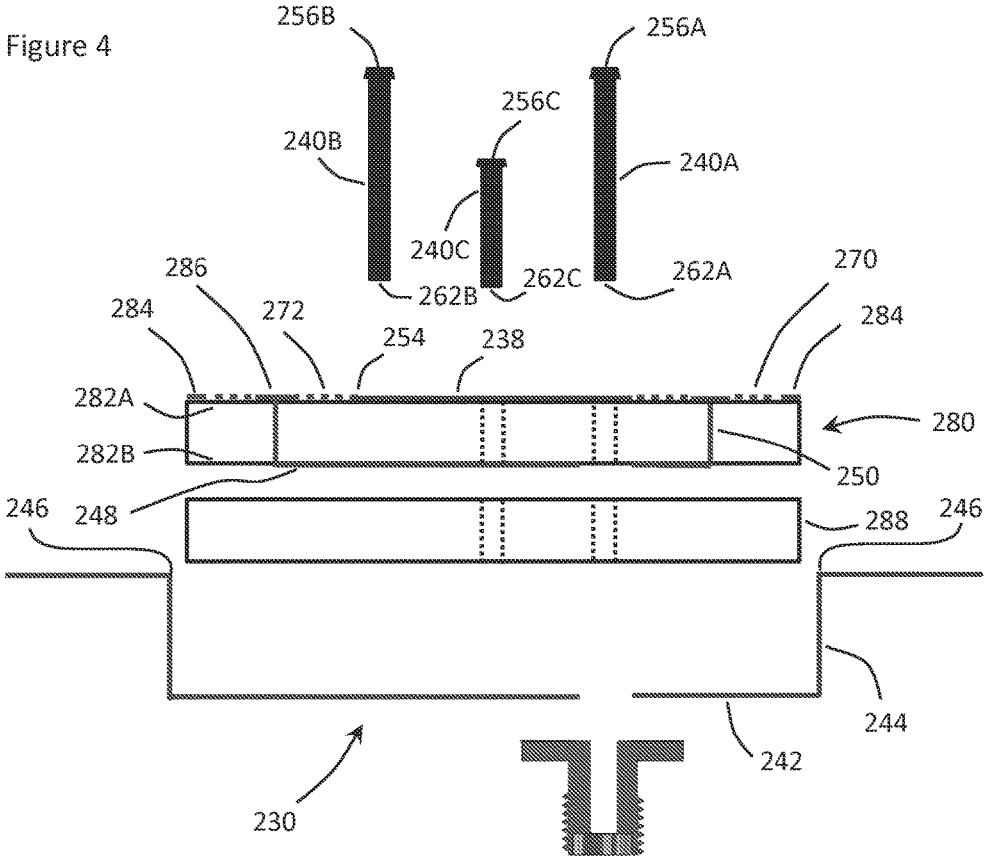
FIG. 4 is an exploded cross-sectional view of the third embodiment of the antenna illustrated in FIGS. 3A and 3B.

With reference to FIG. 4 and continuing reference to FIGS. 3A and 3B, the antenna 220 is also comprised of three structures (excluding the feed and shorting pins) that facilitate the assembly of the antenna 220. The first structure is the first electrically conductive surface 230. The second structure 280 is a planar dielectric with first and second parallel faces 282A, 282B. The first parallel face 282A supports an extension 284 of the first edge 244 that extends towards the inner edge 250, the slot modification structure 270, an extension 286 of the second edge 250 that extends towards the first edge 244 and towards the third edge 254, the slot modification structure 272, and the third electrically conductive element 238. The second parallel face 282B supports the second bottom wall 248. The second side wall 250 that extends from the extension 286 to the second bottom wall 248 is realized by a plurality via holes 287 (See FIG. 3A) that extend between the first and second parallel faces 282A, 282B that are plated or filled with an electrically conductive material that engages the extension 286 and the inner bottom wall 248. The spacing between consecutive via holes is nominally less than 0.1λ of the highest of the two center frequencies. The third structure 288 is a planar dielectric.

The antenna 220 is assembled by placing the third structure 288 between the first bottom wall 242 and the second structure 280. The extension 284 is then electrically connected to the outer edge 246 of the outer surface 230.

The antenna embodiments illustrated in FIGS. 1A-1B, 2A-2B, and 3A-3B each define two slots that can each be characterized as being closed-loop slots. In the case of the antennas 20 and 220, the slots each have a circular characteristic, a type of closed-loop. In the case of antenna 120, the slots can be characterized as rectangular closed-loops. Also feasible are embodiments that define: (a) slots that each has a non-closed loop characteristic and (b) one slot with a closed loop characteristic and the other slot with a non-closed loop characteristic.

With reference to FIGS. 5A-5C, a fourth embodiment of a dual-frequency stacked patch antenna structure 320, hereinafter antenna 320, with two slots that each has a non-closed loop characteristic is described. Generally, the antenna 320 includes a first electrically conductive concave surface 322 with a first edge 324, a second electrically conductive concave surface 326 with a second edge 328, and a third electrically conductive element 330 with a third edge 332. The first and second edges 324, 328 define a first slot 334. The second and third edges 328, 332 define a second slot 336. The first slot 334 extends from a first terminal end 334A to a second terminal end 334B and, as such, defines a non-closed loop. The second slot 336 extends from a first terminal end 336A to a second terminal end 336B and, as such, defines a non-closed loop. Located within each of the first and second slots 334, 336 is a multi-digit structure that is schematically represented by cross-hatching. To simplify the drawings, the feed structure has been omitted. However, feed structures known to those skilled in the art can be utilized. Notably, in this antenna, an electrically conductive surface in the area 338 is common to a portion of the first electrically conductive concave surface 322 and a portion of the second electrically conductive surface 326. This common surface can be realized by the first and second electrically conductive surfaces 322, 326 contacting each other in the area 338 or sharing the same electrically conductive material in this area.

Figures 6A, 6B, 6C:
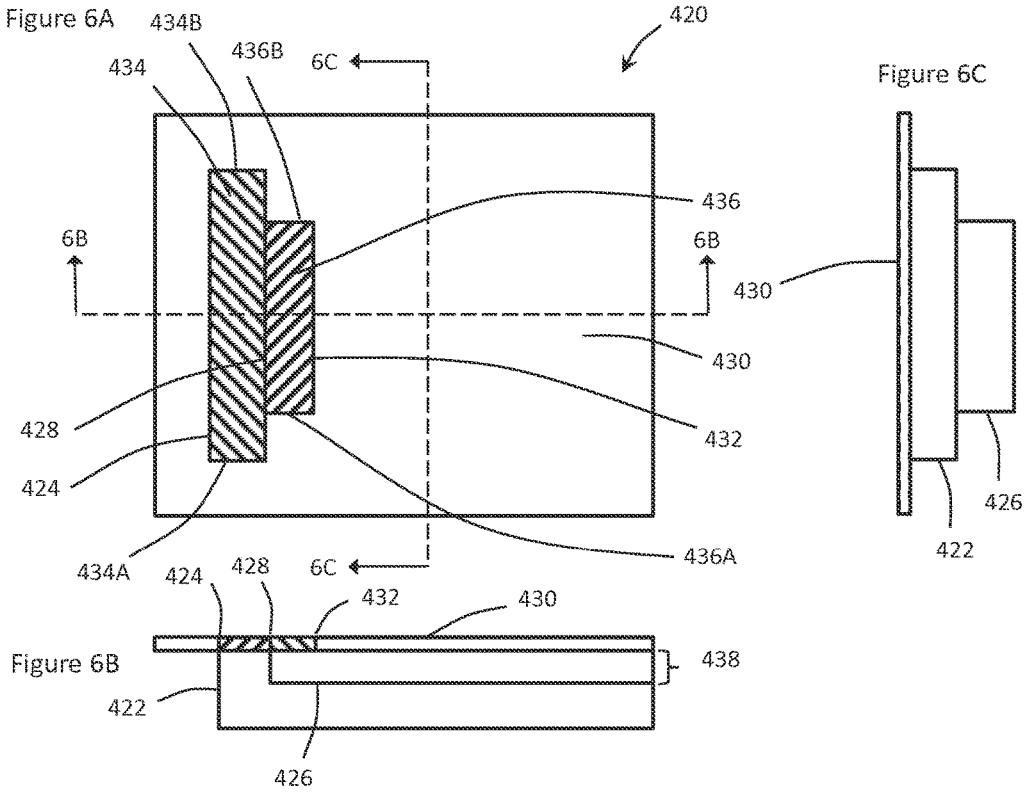
FIGS. 6A-6C respectively show schematic and orthogonal top, first side, and second side views of an embodiment of a dual-frequency stacked patch antenna that defines first and second slots that are each linear.

With reference to FIGS. 6A-6C, a fifth embodiment of a dual-frequency stacked patch antenna structure 420, hereinafter antenna 420, with two slots that each has a non-closed loop characteristic is described. Generally, the antenna 420 includes a first electrically conductive concave surface 422 with a first edge 424, a second electrically conductive concave surface 426 with a second edge 428, and a third electrically conductive element 430 with a third edge 432. The first and second edges 424, 428 define a first slot 434. The second and third edges 428, 432 define a second slot 436. The first slot 434 extends from a first terminal end 434A to a second terminal end 434B and, as such, defines a linear slot (a type of non-closed loop). The second slot 436 extends from a first terminal end 436A to a second terminal end 436B and, as such, defines a linear slot. Located within each of the first and second slots 434, 436 is a multi-digit structure that is schematically represented by cross-hatching. To simplify the drawings, the feed structure has been omitted. However, feed structures known to those skilled in the art can be utilized. Notably, in this antenna, an electrically conductive surface in the area 438 is common to a portion of the first electrically conductive concave surface 422 and a portion of the second electrically conductive surface 426. This common surface can be realized by the first and second electrically conductive surfaces 422, 426 contacting each other in the area 438 or sharing the same electrically conductive material in this area.

Figure 7A:
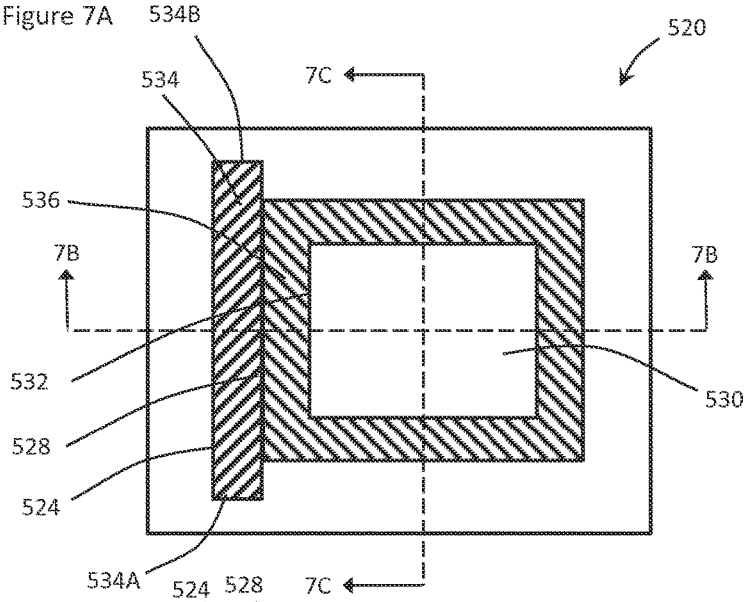
FIGS. 7A-7C respectively show schematic and orthogonal top, first side, and second side views of an embodiment of a dual-frequency stacked patch antenna that defines a first slot that forms a closed loop and a second slot that is linear.
Figure 7C:
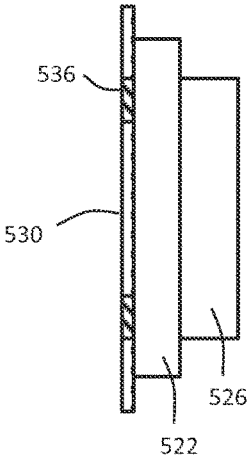
Figure 7B:
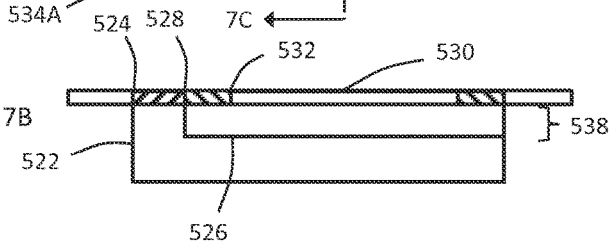

With reference to FIGS. 7A-7C, a sixth embodiment of a dual-frequency stacked patch antenna structure 520, hereinafter antenna 520, with one slot that has a non-closed loop characteristic and another slot that has a closed-loop characteristic is described. Generally, the antenna 520 includes a first electrically conductive concave surface 522 with a first edge 524, a second electrically conductive concave surface 526 with a second edge 528, and a third electrically conductive element 530 with a third edge 532. The first and second edges 524, 528 define a first slot 534. The second and third edges 528, 532 define a second slot 536. The first slot 534 extends from a first terminal end 534A to a second terminal end 534B and, as such, defines a linear slot. In contrast, the second slot 536 defines a closed loop. Located within each of the first and second slots 534, 536 is a multi-digit structure that is schematically represented by cross-hatching. To simplify the drawings, the feed structure has been omitted. However, feed structures known to those skilled in the art can be utilized. Notably, in this antenna, an electrically conductive surface in the area 538 is common to a portion of the first electrically conductive concave surface 522 and a portion of the second electrically conductive surface 526. This common surface can be realized by the first and second electrically conductive surfaces 522, 526 contacting each other in the area 538 or sharing the same electrically conductive material in this area.

Figure 8A:
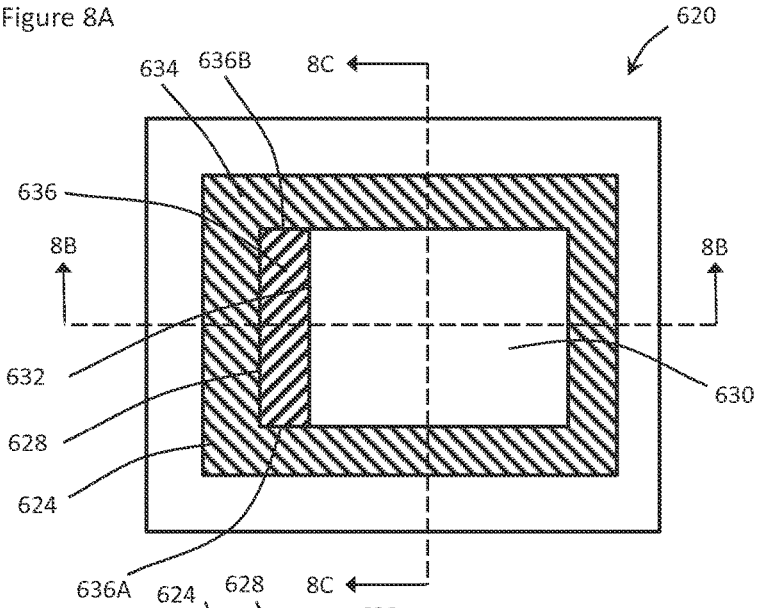
FIGS. 8A-8C respectively show schematic and orthogonal top, first side, and second side views of an embodiment of a dual-frequency stacked patch antenna that defines a first slot that forms a closed loop and a second slot that is linear.
Figure 8B:
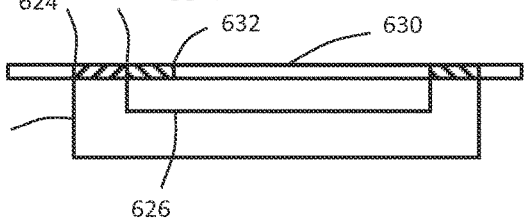
Figure 8C:
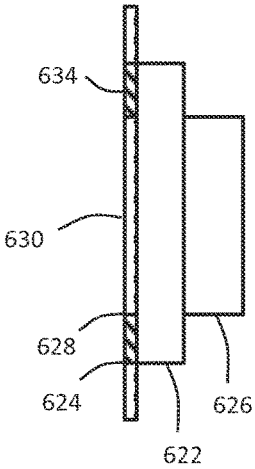

With reference to FIGS. 8A-8C, a seventh embodiment of a dual-frequency stacked patch antenna structure 620, hereinafter antenna 620, with one slot that has a non-closed loop characteristic and another slot that has a closed-loop characteristic is described. Generally, the antenna 620 includes a first electrically conductive concave surface 622 with a first edge 624, a second electrically conductive concave surface 626 with a second edge 628, and a third electrically conductive element 630 with a third edge 632. The first and second edges 624, 628 define a first slot 634. The second and third edges 628, 632 define a second slot 636. The first slot 634 forms a closed-loop. The second slot 636 extends from a first terminal end 636A to a second terminal end 636B and, as such, defines a linear slot. Located within each of the first and second slots 634, 636 is a multi-digit structure that is schematically represented by cross-hatching. To simplify the drawings, the feed structure has been omitted. However, feed structures known to those skilled in the art can be utilized.

Figure 9:
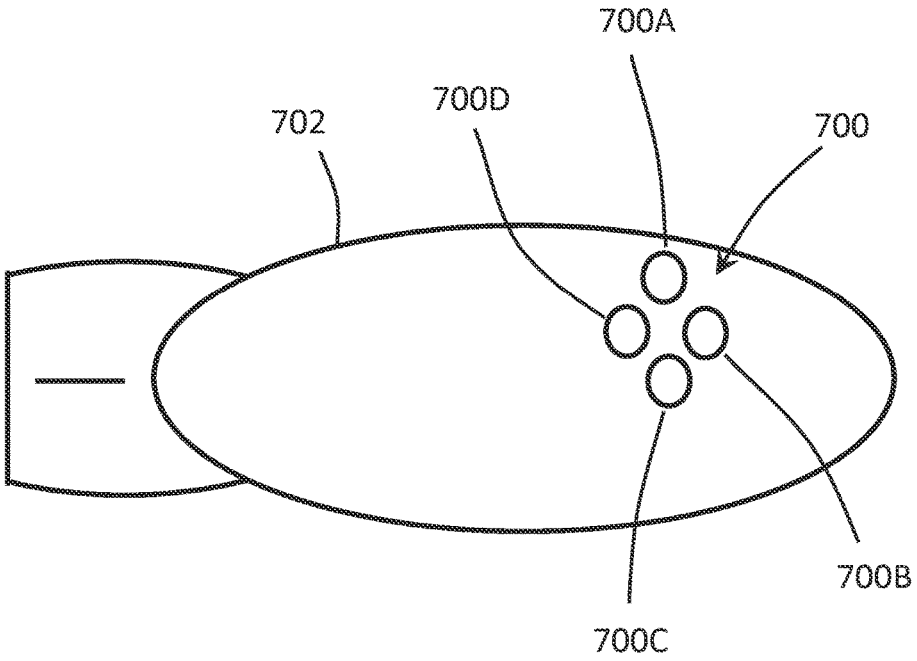
FIG. 9 is a schematic view of a munition that incorporates an array of dual-frequency stacked patch antennas.

FIG. 9 illustrates an array of dual-frequency stacked patch antennas 700 associated with a munition 702. The array 700 comprises four, dual-frequency stacked patch antenna 700A-700D. Each of the antennas 700A-700D comprises a first electrically conductive concave surface with a first, second electrically conductive concave surface with a second edge, third electrically conductive surface with a third edge, first slot, second slot, and a multi-digit structures in each of the slots in accordance with the teachings herein. Further, the antennas 700A-700D are each situated in a cavity or in a collective cavity defined by the exterior surface of the munition. Further, each of the antennas 700A-700D is conformal with the exterior surface of the munition 702 adjacent to the location of the antenna. In this particular embodiment, the exterior surface of the munition is non-planar and has complex curvature. As a consequence, at least two of the antennas 700A-700D present different exterior surfaces. The array 700 can potentially be used to steer a beam, generate one of more nulls in the beam pattern, and/or shape the beam. Additionally, the array 700 presents a higher gain than a single or array with fewer, comparable antennas. As should be appreciated, arrays of at least two antennas and more than two antennas are feasible. Further, arrays with regular or irregularly spacing between antennas are feasible.

The foregoing description of the invention is intended to explain the invention and to enable others skilled in the art to utilize the invention in various embodiments and with the various modifications required by their particular applications or uses of the invention.

What is claimed is:

1. A stacked patch antenna structure comprising:

a first electrically conductive element having a first concave surface with an extent defined by a first edge;

a second electrically conductive element having a second concave surface with an extent defined by a second edge;

a third electrically conductive element defining an outer surface and having an extent defined by a third edge;

wherein the first and second electrically conductive elements are positioned relative to one another such that the first and second concave surfaces substantially face in the same direction;

wherein the second concave surface is substantially located between the third electrically conductive element and the first concave surface.

2. A stacked patch antenna structure, as claimed in claim 1, further comprising:

a first multi-digit electrically conductive structure extending away from one of the first edge and the second edge and towards the other of the first edge and second edge; and a second multi-digit electrically conductive structure extending away from one of the second edge and the third edge and towards the other of the second edge and third edge.

3. A stacked patch antenna structure, as claimed in claim 1, further comprising:

a first multi-digit electrically conductive structure extending away from the first edge and towards the second edge;

a second multi-digit electrically conductive structure extending away from the second edge and towards the first edge;

a third multi-digit electrically conductive structure extending away from the second edge and toward the third edge; and a fourth multi-digit electrically conductive structure extending from the third edge towards the second edge;

wherein at least one digit of the first multi-digit electrically conductive structure is interleaved between two digits of the second multi-digit electrically conductive structure;

wherein at least one digit of the second multi-digit electrically conductive structure is interleaved between two digits of the first multi-digit electrically conductive structure;

wherein at least one digit of the third multi-digit electrically conductive structure is interleaved between two digits of the fourth multi-digit electrically conductive structure;

wherein at least one digit of the fourth multi-digit electrically conductive structure is interleaved between two digits of the third multi-digit electrically conductive structure.

4. A stacked patch antenna structure, as claimed in claim 1, further comprising:

a first multi-digit electrically conductive structure extending away from the second edge and towards the first edge;

a second multi-digit electrically conductive structure extending away from the second edge and towards the third edge.

5. A stacked patch antenna structure, as claimed in claim 4, further comprising:

a third multi-digit electrically conductive structure extending away from the first edge towards the second edge and interleaving with the first multi-digit electrically conductive structure.

6. A stacked patch antenna structure, as claimed in claim 4, further comprising:

a fourth multi-digit electrically conductive structure extending away from the third edge towards the second edge and interleaving with the second multi-digit electrically conductive structure.

7. A stacked patch antenna structure, as claimed in claim 4, further comprising:

a third multi-digit electrically conductive structure extending away from the first edge towards the second edge and interleaving with the first multi-digit electrically conductive structure; and a fourth multi-digit electrically conductive structure extending away from the third edge towards the second edge and interleaving with the second multi-digit electrically conductive structure.

8. A stacked patch antenna structure, as claimed in claim 1, wherein:

the first edge, second edge, and third element define a substantially planar surface.

9. A stacked patch antenna structure, as claimed in claim 1, wherein:

the first edge, second edge, and third element define a curved surface.

10. A stacked patch antenna structure, as claimed in claim 1, further comprising:

a mounting structure with a mount outer surface and an enclosed edge that defines a cavity for receiving the first element;

the mounting structure supporting the first element such that the first edge is positioned adjacent to the enclosed edge;

the first edge, second edge, and third element defining a surface that substantially conforms to the portion of the mount outer surface located adjacent to the enclosed edge.

11. A stacked patch antenna structure, as claimed in claim 1, wherein:

the mounting structure is associated with a munition.

12. A stacked patch antenna structure, as claimed in claim 1, further comprising:

a munition for supporting the first, second, and third elements.

13. A stacked patch antenna structure, as claimed in claim 1, wherein:

the first, second, and third elements form a first stacked patch antenna structure.

14. A stacked patch antenna structure, as claimed in claim 13, further comprising:

a second stacked patch antenna structure having first, second, and third elements as defined in claim 1;

wherein the first and second stacked patch antenna structures are positioned to form an antenna array.

15. A stacked patch antenna structure, as claimed in claim 1, wherein:

a first slot defined by the first edge and the second edge; and a second slot defined by the second edge and the third edge.

16. A stacked patch antenna structure, as claimed in claim 15, wherein:

the first slot forms a closed-loop; and the second slot forms a closed-loop.

17. A stacked patch antenna structure, as claimed in claim 15, wherein:

the first slot forms a non-closed loop; and the second slot forms a non-closed loop.

18. A stacked patch antenna structure, as claimed in claim 15, wherein:

the first slot forms one of a closed-loop and a non-closed loop; and the second slot forms the other one of a closed-loop and a non-closed loop.

19. A stacked patch antenna structure comprising:

a first element that includes a first electrically conductive member with a first tub-like shape defined by a first planar bottom wall and a first side wall that extends away from the first bottom wall to a first edge;

a second element that includes: (a) a first planar dielectric with a first planar face, a second planar face that is separated from and substantially parallel to the first planar face, and a first dielectric edge extending between the first and second planar faces, (b) a second electrically conductive member with a second tub-like shape defined by a second bottom wall that is operatively attached to the second planar face and a second side wall that extends from a second edge that is substantially adjacent to the first planar face to the second bottom wall, and (c) a third electrically conductive member operatively attached to the first planar face and having an extent defined by a third edge;

a third element that includes a second planar dielectric structure with a third planar face, a fourth planar face that is separated from and substantially parallel to the third planar face, and a second dielectric edge extending between the third and fourth planar faces;

wherein the third element is location between the first and second elements such that: (a) the third planar face is immediately adjacent to the second planar dielectric face and (b) the fourth planar face is immediately adjacent to the first planar bottom wall.

20. A stacked patch antenna structure, as claimed in claim 19, further comprising:

a first multi-digit electrically conductive structure extending away from the first edge and towards the second edge;

a second multi-digit electrically conductive structure extending away from the second edge and towards the first edge;

a third multi-digit electrically conductive structure extending away from the second edge and toward the third edge; and a fourth multi-digit electrically conductive structure extending from the third edge towards the second edge;

wherein at least one digit of the first multi-digit electrically conductive structure is interleaved between two digits of the second multi-digit electrically conductive structure;

wherein at least one digit of the second multi-digit electrically conductive structure is interleaved between two digits of the first multi-digit electrically conductive structure;

wherein at least one digit of the third multi-digit electrically conductive structure is interleaved between two digits of the fourth multi-digit electrically conductive structure;

wherein at least one digit of the fourth multi-digit electrically conductive structure is interleaved between two digits of the third multi-digit electrically conductive structure.

21. A stacked patch antenna structure, as claimed in claim 19, wherein:

the first side wall is entirely separated from the second side wall.

22. A stacked patch antenna structure, as claimed in claim 19, wherein:

a portion of the first side wall is a portion of the second side wall.

* * * * *